United States Patent [19]

Koshman et al.

[11] 4,277,766

[45] Jul. 7, 1981

[54] ELECTRIC CIRCUIT SWITCHING DEVICE

[76] Inventors: Vitaly I. Koshman, bulvar Shevchenko, 123, kv. 25; Vladimir F. Petrichenko, ulitsa Prozhektornaya, 6, kv. 44; Pavel V. Kamshitsky, prospekt Mira, 53a, kv. 23, all of Donetsk, U.S.S.R.

[21] Appl. No.: 32,020

[22] Filed: Apr. 20, 1979

[51] Int. Cl.[3] ..... H01H 67/06

[52] U.S. Cl. ..... 335/122; 335/114

[58] Field of Search ..... 335/122, 114, 130

[56] References Cited

U.S. PATENT DOCUMENTS

| | | | |
|---|---|---|---|
| Re. 23,453 | 1/1952 | Schleicher | 335/130 |
| 2,983,802 | 5/1961 | Hannon | 335/122 |

*Primary Examiner*—Harold Broome

*Attorney, Agent, or Firm*—Lackenbach, Lilling & Siegel

[57] ABSTRACT

An electric circuit switching device comprises a group of closing contact pairs and a group of breaking contact pairs, each group having stationary contacts arranged circumferentially on an insulating panel, and a switching element; a unit for rotating the switching elements; and an electromagnetic drive providing translatory motion of the switching elements while closing and breaking the contact pairs. The unit for rotating the switching elements is a rotary electromechanical drive having a means for setting the angle of rotation of its output shaft depending on the position of the contacts to be switched on the insulating panel. The electromagnetic drive has two electromagnets, the first of which provides translatory motion of the switching element of the group of the closing contact pairs, and the second electromagnet providing translatory motion of the switching element of the group of the breaking contact pairs. Each electromagnet has a hollow core supporting a winding and embracing the output shaft of the rotary electromechanical drive, and an armature having a recoil spring rigidly connected to a respective switching element, electrically insulated from the switching element and mounted for movement along the output shaft. The group of the breaking contact pairs, apart from the stationary contacts, have spring-loaded contacts, each forming with one of the stationary contacts of said group a contact pair and being actuated by the switching element while breaking the contact pairs of said group.

4 Claims, 6 Drawing Figures

ELECTRIC CIRCUIT SWITCHING DEVICE

BACKGROUND OF THE INVENTION

1. Field of the Invention

The present invention relates to the remote control of electric power actuated apparatuses and more particularly to electric circuit switching devices.

This invention can be used in devices for controlling a group of electric power actuated apparatuses, for instance, a group of electric motors, in various branches of industry, particularly in coal mining.

2. Description of the Prior Art

Known in the art are devices for controlling a group of electric motors (control stations) comprising a plurality of contactors, intermidiate electromagnetic relays and other switching elements, the number of which depends on the number of electric motors to be controlled. Such devices are complicated in construction, bulky and not very reliable in operation.

Furthermore, the designing of devices for controlling machines operated in mines with a dangerously explosive atmosphere offers special difficulties since insuring the safety of operation in such mines requires meeting a number of specific safety requirements such as, for instance, testing of insulation of the electric circuits connecting production equipment with power sources. Such testing is carried out before each of the above electric circuits is connected to the sources of electric power. In order to meet these requirements, it is necessary that special control means be included in each set of devices, intended for controlling only one electric power actuated apparatus.

Also known in the art is a high voltage circuit switching device (c.f. USSR Inventor's Certificate No. 320,846) comprising a group of closing contact pairs and a group of breaking contact pairs, each of the pairs having stationary contacts arranged circumferentially on the insulating panel, and a switching element. In addition, the switching device includes a unit for rotating the switching elements and an electromagnetic drive providing translatory motion of the switching elements while closing and breaking contacts. The electromagnetic drive in said switching device is a solenoid, the armature of which has switching elements on its opposite ends. Each of the switching elements is a disk made of an insulating material and has a pair of electrically connected contacts. The armature of the solenoid moves between parallel insulating panels, each of the panels carrying said stationary contacts being arranged perpendicular to the direction of its movement. Rotation of the armature of the solenoid about its axis and, consequently, of the switching elements through a preset angle is effected by a unit comprising a cam mounted on the armature of the solenoid. On the cylindrical surface of the cam there is a saw-like groove, while on the body of the solenoid is mounted a spring-loaded pin set into said saw-like groove.

The above switching device makes it possible to alternately close and break the contacts arranged beside each other, but does not provide for selective switching thereof. In addition, the aforedescribed switching device does not ensure the protection of the electric power actuated apparatuses in case of zero voltage in the feed line. Thus, to provide reliable control of a group of electric power actuated apparatuses apart from the above switching device, various additional elements and means, such as relays, are required, which makes the electric circuit of the controlling device more complicated.

It should be pointed out that the increase in the number of electric power actuated apparatuses leads to an enlargement of the switching device dimensions and to more complicated electric connections.

It is also worthwhile pointing out that said switching device does not permit closing each of those contacts regardless of breaking the others.

SUMMARY OF THE INVENTION

The principal object of the invention is the provision of a device for switching electric circuits, which, acting as a distributor of a plurality of intermediate relays and using a minimum number of electromagnetic elements, would be capable of selectively controlling a plurality of electric power actuated apparatuses.

Another object of the invention is to simplify the construction of a device for controlling a group of electric power actuated apparatuses, including an electric circuit switching gear.

Still another object of the invention is to reduce the size of a device for controlling a group of electric power actuated apparatuses.

It is an object of the invention to provide a considerable saving of ferrous, non-ferrous and precious metals by using a device for switching electric circuits.

These and other objects of the invention are attained by a device for switching electric circuits, comprising a group of closing contact pairs and a group of breaking contact pairs, each said pair having stationary contacts arranged circumferentially on an insulating panel, and a switching element; a unit for rotating the switching elements; and an electromagnetic drive providing translatory motion of the switching elements while closing and breaking contact pairs. According to the invention, the unit for rotating the switching elements is a rotary electromechanical drive having a means for setting the angle of rotation of its output shaft, said angle of rotation being determined depending on the position of the stationary contacts to be switched on the insulating panels. The electromagnetic drive has two electromagnets, the first of which provides the translatory motion of the switching element of the group of the closing contact pairs, and second of which provides the translatory motion of the switching element of the group of the breaking contact pairs. Each of the two electromagnets has a hollow core supporting a winding and embracing the output shaft of the rotary electromechanical drive, and an armature provided with a recoil spring, rigidly connected to a respective switching element, electrically insulated from the switching element and mounted for movement along said output shaft. The group of the breaking contact pairs has spring-loaded contacts, each forming a contact pair with one of the stationary contacts of said group, the spring-loaded contacts being actuated by the switching element during breaking of the contact pairs of said group.

The above switching device, combining the functions of a distributor and a relay, enables switching on and off a considerable number of electric circuits, for instance, feed circuits of the contactor coils, using only two electromagnets, which results in a considerable decrease of space accupied by the controlling equipment.

Furthermore, using the above device makes it possible to reduce the size, weight and cost of the device for controlling a group of electric power actuated apparatuses (control stations);

to simplify the construction and increase the reliability of the device for controlling a group of electric power actuated apparatuses; and to save copper wire utilized for windings, mounting wires and control circuits.

It is advisable that the output shaft of the rotary electromechanical drive in the device for switching electric circuits be constructed in the form of tubular elements connected together with a detachable joint, and wherein there are located recoil springs of the electromagnets.

The aforedescribed construction of the output shaft further decreases the size of the switching device thus making it more compact.

It is also advisable that in the electric circuit switching device the means for setting the angle of rotation of the switching elements be provided with a cross-piece mounted on the output shaft of the rotary electromechanical drive and operating, during rotation, at least one of the limit switches located circumferentially on the insulating panel.

The use of the proposed setting device makes it possible to simplify to a great extent the control circuit for controlling electric power actuated apparatuses. With such setting means there is no need for any auxiliary devices for controlling the contactors, except ordinary control buttons. The setting device enables it to carry out additional switching programs as well.

It is expendient to construct the electric circuit switching device so that on the cross-piece there would be mounted at least one roller through which said cross-piece actuates the limit switches.

The presence of the roller on the cross-piece considerably increases the wear-resistance of the above electric circuit switching device.

BRIEF DESCRIPTION OF THE DRAWINGS

The invention will now be described in detail with reference to the accompanying drawings illustrating a specific embodiment thereof, in which.

DETAILED DESCRIPTION OF THE INVENTION

Figure 1:
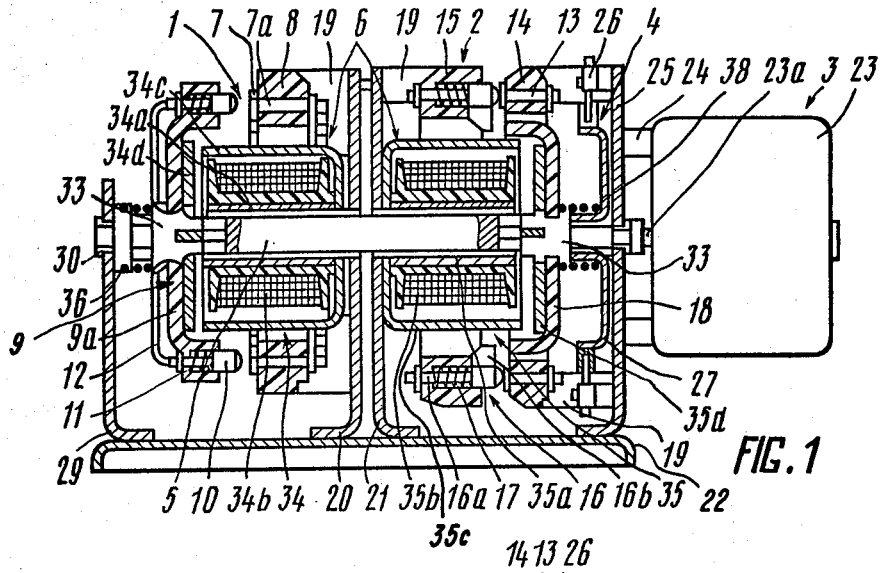
FIG. 1 is a sectional view of an electric circuit switching device according to the invention.

An electric circuit switching device according to the present invention comprises the following principal functional units (FIG. 1): group 1 of closing contact pairs, group 2 of breaking contact pairs, a rotary electromechanical drive 3, a means 4 for setting the angle of rotation of an output shaft 5 of the rotary electromechanical drive 3, and an electromagnetic drive 6.

The group 1 of the closing contact pairs comprises a plurality of contacts 7 arranged circumferentially on the surface of an insulating panel 8. The number of contacts 7 is determined by the number of electric circuits to be controlled and, consequently, by the number of electric power actuated apparatuses. As will be seen below, the construction of the switching device practically does not limit the number of electric power actuated apparatuses. FIGS. 1, 2, 3, 4 and 5 show an alternative embodiment of the electric circuit switching device.

The contacts 7 are provided with rods 7*a* which are inserted into the holes on the insulating panel 8 and have on their ends means for connecting electric wires connecting the electric circuit switching device to a power source and to electric power actuated apparatuses. Said wires can be connected to the rods 7*a* by using any known and suitable method for instance, soldering. According to the preferred embodiment of the invention, the insulating panel 8 has a hole in its center, the purpose of the hole will be explained below.

This group 1 of contact pairs also comprises a switching element 9 (FIGS. 1, 2 and 3) which is a cross-piece made of an insulating material and which may have the form of a disk having spring-loaded contacts arranged circumferentially on its periphery, each of said contacts being disposed, at a required moment, against one of the contacts 7 (FIG. 1) thus forming with one of them a contact pair during the switching process. The cross-piece may be otherwise constructed, provided that the spring-loaded contacts could form contact pairs with the contacts 7. The number of spring-loaded contacts as well as the number of the contacts 7 depends on the specific conditions under which the above switching device is used.

Figure 2:
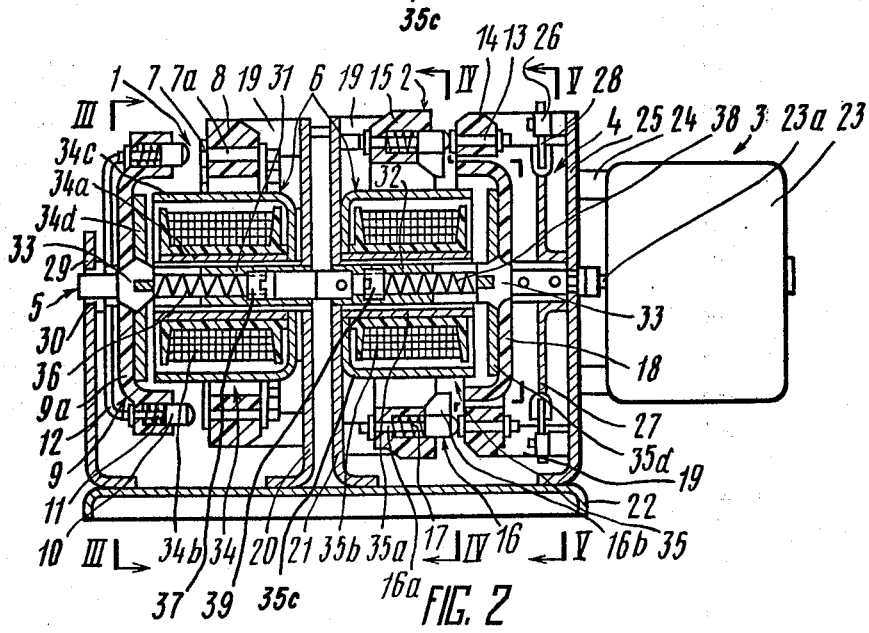
FIG. 2 is a sectional view of a preferred embodiment of the switching device according to the invention.
Figure 3:
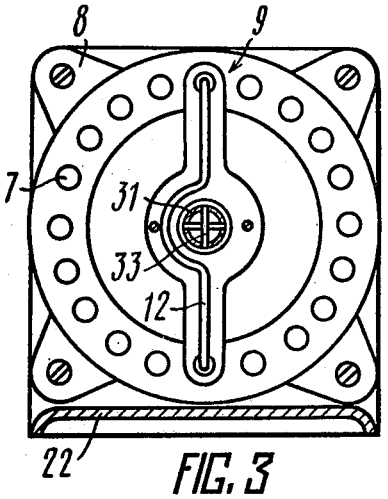
FIG. 3 is a sectional view of the switching device taken along line III—III of FIG. 2.
Figure 4:
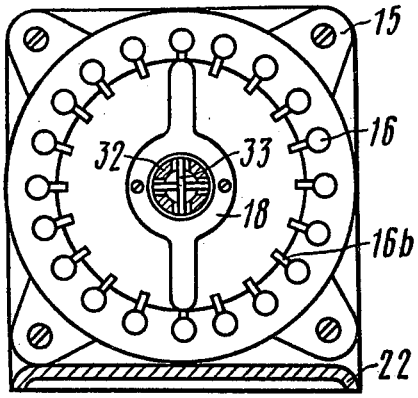
FIG. 4 is a sectional view of the switching device taken along line IV—IV of FIG. 2.
Figure 5:
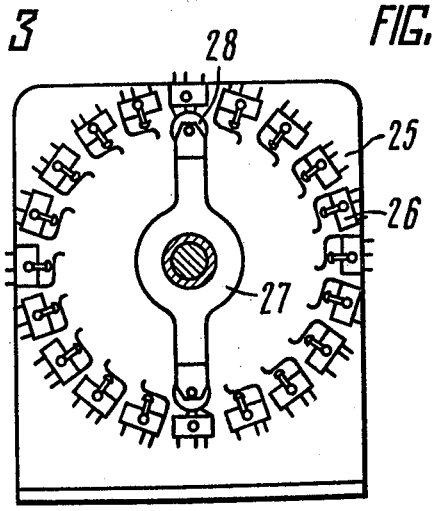
FIG. 5 is a sectional view of the switching device taken along line V—V of FIG. 2.

As can be seen from FIGS. 1 and 2 of the preferred embodiment of the invention, the cross-piece 9*a* of the switching element 9 has the form of a bridge on the ends of which there are mounted contact pins 10 provided with shock absorbing springs 11 and electrically connected with one another by means of a conductor 12 (c.f. FIG. 3). In the center of the yoke 9*a*, there is a hole the purpose of which will be explained below.

The group 2 of the breaking contact pairs comprises a plurality of stationary contacts 13 arranged circumferentially on the surface of an insulating panel 14 in the center of which there is a hole. The construction and arrangement of the contacts 13 and 7 is the same. According to the preferred embodiment of the invention the group 2 comprises an additional insulating panel 15 (FIGS. 1, 2 and 4) on the surface of which there are circumferentially arranged contacts 16 provided with shock absorbing springs 17. Each of the contacts 16 is located against one of the contacts 13 and has a rod 16*a* inserted into the panel 15. Each of the contacts 16 also has a stem 16*b* (FIGS. 1, 2 and 4) extended towards the center of the panel 15 upon which these contacts are arranged. On the ends of the rods 16*a* there are means for fastening connecting electric wires, said means being similar to those described with regard to the group 1.

In the center of the panel 15 there is a hole the purpose of which will be also explained below.

The group 2 of the breaking contact pairs comprises a switching element 18 made of an insulating material and having the form of a disk with projections bent in the direction of the stems 16*b*. In the center of the switching element 18 there is a hole the purpose of which will be explained below.

The insulating panels 8 and 14 and the additional insulating panel 15 are fixed to a base 22 by means of columns 19 and supports 20 and 21.

The rotary electromechanical drive 3 and the means 4 for setting the angle of rotation of the output shaft 5 may be variously constructed. It should be pointed out that a step-by-step motor known in the art, which combines the characteristics of both of the above devices, can be used as one of the alternative embodiments. The use of the step-by-step motor makes it possible to decrease the number of connecting electric wires used for controlling the switching device, but requires an additional control pulse source.

According to the preferred embodiment of the invention, the rotary electromechanical drive 3 (FIGS. 1 and 2) is an electromotor 23 whose shaft 23*a* is coupled with the output shaft 5.

If necessary, the electromotor 23 may be provided with a reduction gear (not shown in the drawings). The electromotor 23 is fixed on the base 22 by means of columns 24 and a support 25.

According to the invention, the means 4 for setting the angle of rotation of the output shaft 5 comprises limit switches 26 (FIGS. 1, 2 and 5) arranged circumferentially on the support 25. On the output shaft 5 there is mounted a cross-piece 27 which, while rotating, actuates the limit switches 26. Each of the limit switches 26 has one closing contact and one breaking contact. The number of limit switches 26 is determined by the number of electric power actuated apparatuses. The above cross-piece may be made in the form of a star the projections of which must be long enough to operate the limit switches 26. In the preferred embodiment of the invention, on each of the projections of the cross-piece 27 there is mounted a roller 28 by means of which the cross-piece 27 operates the limit switches 26. In this case the form of the cross-piece may differ.

Other embodiments (not shown in the drawings) of the means 4 for setting the angle of rotation of the output shaft 5 are also possible, for instance, an alternative embodiment wherein the limit switches are magnet-controlled contacts actuated by permanent magnets mounted on the ends of the cross-piece 27.

The means 4 for setting the angle of rotation of the output shaft 5 of the rotary electromechanical drive may be used in the described switching device to perform two independent functions.

When the electric power actuated apparatuses are controlled by means of buttons, which, naturally, involves a great number of connecting wires, the function of the above means is to stop switching elements at the contacts which are to be closed or broken.

When the electric circuit switching device is used in combination with some other means providing rotation of the switching elements through a pre-set angle, thus enabling selection of a contact to be closed or broken, the means 4 can be used for controlling the position of the switching elements with respect to the stationary contacts, or for signalling. In this case, the required number of electric power actuated apparatuses can be controlled through two or three wires.

The central holes in the members 8, 9*a*, 14, 15 and 18 (FIGS. 1, 2) as well as the holes in the supports 25 and 29, 20 and 21 are coaxial and their diameters are big enough for the output shaft 5 of the rotary electromechanical drive 3 to pass through them. The ends of the shaft 5 rest upon bearings 30. In the preferred embodiment of the invention the output shaft 5 is hollow and assembled of tubular elements 31 and 32 coupled together with a detachable joint.

The switching elements 9 and 18 are mounted on the output shaft 5 by means of shaped plates 33 set into the grooves of the output shaft 5, these grooves preventing rotation of the elements on the shaft and permitting axial movement of them.

The electromagnetic drive 6 comprises two electromagnets 34 and 35. The electromagnet 34 has a hollow core 34*a* embracing the output shaft 5. On the core 34*a* is mounted a coil 34*b*. The magnet case 34*c* functions as a frame of this electromagnet. The armature 34*d* of this electromagnet is fastened to the inner side of the switching element 9 and provided with a recoil spring 36.

As can be seen from FIG. 2, in the preferred embodiment of the invention the recoil spring 36 is located inside the hollow output shaft 5. The counter-force of the armature 34*d* is regulated by means of a screw 37.

The electromagnet 35 (FIGS. 1 and 2) is similar to the electromagnet 34 and has a hollow core 35*a*, a coil 35*b*, a magnet case 35*c* and an armature 35*d*. The armature 35*d* is fastened to the inner side of the switching element 18 and provided with a recoil spring 38 mounted inside the hollow output shaft 5. The counter-force of the armature 35*d* is regulated by means of a screw 39.

The electromagnets 34 and 35 are fixed to the supports 20 and 21 respectively.

Figure 6:
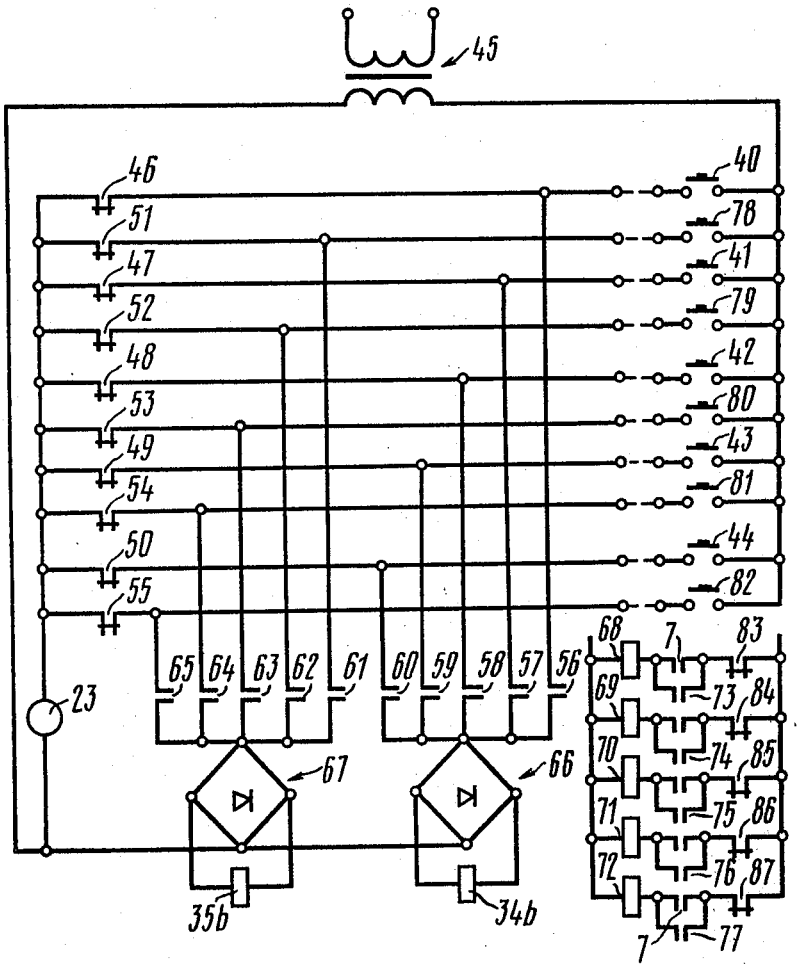
FIG. 6 is an electrical schematic drawing of an alternative control circuit for a number of electric power actuated apparatuses, incorporating the electric circuit switching device according to the invention.

To illustrate the operation of the described switching device, FIG. 6 shows a push-button control diagram for five electric power actuated apparatuses. Power circuits of the contactors are not shown in the diagram. The numerals in the diagram denote: 40, 41, 42, 43 and 44—start buttons; 45—reducing transformer; 46, 47, 48, 49, 50, 51, 52, 53, 54 and 55—breaking contacts of the limit switches 26; 56, 57, 58, 59, 60, 61, 62, 63, 64 and 65—closing contacts of the limit switches 26; 66 and 67—rectifying bridges; 68, 69, 70, 71 and 72—contactors of the electric power actuated apparatuses; 73, 74, 75, 76 and 77—auxiliary contacts of the contactors 68, 69, 70, 71 and 72 respectively; 78, 79, 80, 81 and 82—stop buttons; and 83, 84, 85, 86 and 87—breaking contact pairs of group 2, each of the pairs being formed by contacts 13 and 16.

On pressing one of the start buttons 40, 41, 42, 43 or 44, for instance, the button 40, the electromotor 23 of the rotary drive is coupled to a completed circuit including a winding of the reducing transformer 45, the button 40, a breaking contact 46 of the limit switch 26, the electromotor 23, and the winding of the transformer 45. The electromotor starts rotating and rotates the output shaft 5. When the roller 28 touches the limit switch 26 having the contacts 46 and 56, the contact 46 will be broken thus switching off the electromotor 23 and the shaft 5 stops rotating.

The switching elements 9 and 18 will stop above the contacts corresponding to the above limit switch 26. Concurrently, the contact 56 will be closed thus feeding the coil 34*b* of the electromagnet 34 effecting translatory motion of the switching element 9 of group 1 of the closing contact pairs, through the circuit including a winding of the transformer 45, the button 40, the contact 56, the rectifying bridge 66, the coil 34*b* of the electromagnet, and the winding of the transformer. The electromagnet 34 will operate and the switching element 9 will cause the contacts 7 in the supply circuit of the coil of the contactor 68 to be closed. The electromagnet of the contactor 68 will operate and the contact 7 will be interlocked by the auxiliary contacts 73 of the contactor 68.

On releasing the button 40, the contactor 68 remains closed.

Breaking contacts proceeds in a similar way, the only difference being that, instead of pressing one of the start buttons, a stop button of the group 78, 79, 80, 81 or 82, for instance, the button 78 is pressed.

In this case the electromotor 23 is coupled to a completed circuit through a contact of a respective limit switch of the group of contacts 51, 52, 53, 54 and 55, for instance, the contact 51, the contact 51 breaking under the action of the roller 28, thereby switching off the electromotor 23. Simultaneously, a respective contact of the limit switches 26 in the supply circuit of the coil 35*b* of the electromagnet 35, effecting translatory motion of the switching element 18 of the group 2 of the breaking contact pairs, is closed thereby switching on the coil 35*b* of said electromagnet, fed from the rectifying bridge 67, the armature 35 of the electromagnet being connected to the switching element 18. The switching element 18, by actuating a respective breaking contact of the group 83, 84, 85, 86 or 87, for instance, the contact 83, breaks one of the contacts of the coils, for instance, 58.

The use of the proposed electric circuit switching device in devices for controlling a group of electric power actuated apparatuses has considerable economic advantages due to the reduction of weight, lower cost, and decreased size of said devices, and due to the saving of copper, which is attained by the elimination of intermediate relays and a lesser number of auxiliary elements such as, for instance, a means for insulation testing used in mine explosion-proof control systems.

Normally a means for insulation testing (leakage locking relays) is included in each set of apparatuses intended for controlling an individual electric power actuated apparatus.

The proposed device, due to the presence therein of a means for setting the angle of rotation of the output shaft of the rotary electromechanical drive, enables testing insulation in several circuits to be done by using only one device.

While particular embodiments of the invention have been shown and described, various modifications thereof will be apparent to those skilled in the art and, therefore, it is not intended that the invention be limited to the disclosed embodiments or to the details thereof and departures may be made therefrom within the spirit and scope of the invention as defined in the claims.

We claim:

1. An electric circuit switching device comprising:

a group of closing contact pairs having an insulating panel, stationary contacts arranged along the circumference of said insulating panel, and a switching element;

a group of breaking contact pairs having a main insulating panel, stationary contacts arranged along the circumference of said insulating panel, spring-loaded contacts forming with said stationary contacts breaking contact pairs, and a switching element actuating said spring-loaded contacts while disconnecting said breaking contact pairs;

a unit for rotating said switching elements having a rotary electromechanical drive provided with an output shaft, and means for setting an angle of rotation of the output shaft of said rotary electromechanical drive depending on the position of said stationary contacts to be commutated on said insulating panels; and an electromagnetic drive having a first electromagnet providing translatory motion of said switching element of said group of the closing contact pairs, a second electromagnet providing translatory motion of said switching element of said group of the breaking contact pairs, each of said first and second electromagnets having a winding, a hollow core supporting said winding and embracing the output shaft of said rotary electromechanical drive, and an armature rigidly connected to a respective switching element and electrically insulated therefrom, said armature being mounted for movement along the output shaft of said rotary electromechanical drive and having a recoil spring.

2. An electric circuit switching device according to claim 1, wherein the output shaft of said rotary electromechanical drive includes tubular elements coupled together with detachable joints and accomodating said recoil springs of said armatures of said electromagnets.

3. An electric circuit switching device according to claim 1, wherein said means for setting the angle of rotation of said output shaft comprises;

an insulating panel, a plurality of limit switches arranged circumferentially on said insulating panel, and a cross-piece mounted on the output shaft of said rotary electromechanical drive and operating, while rotating, at least one of said limit switches.

4. An electric circuit switching device according to claim 3, wherein said means for setting the angle of rotation of said output shaft further comprises at least one roller mounted on said cross-piece and through which the cross-piece actuates said limit switches.

* * * * *